US005848547A

United States Patent [19]

Hite

[11] Patent Number: 5,848,547

[45] Date of Patent: Dec. 15, 1998

[54] CASSETTE TOOLING

[75] Inventor: William H. Hite, Tiffin, Ohio

[73] Assignee: The National Machinery Company, Tiffin, Ohio

[21] Appl. No.: 45,454

[22] Filed: Mar. 20, 1998

Related U.S. Application Data

[62] Division of Ser. No. 658,952, May 31, 1996.

[51] Int. Cl.[6] ..... B21J 13/03

[52] U.S. Cl. ..... 72/481.6; 72/481.1; 72/462; 72/405.12

[58] Field of Search ..... 72/481.1, 481.6, 72/481.9, 462, 405.13, 405.12; 470/70, 71, 57, 85, 91, 63, 137

[56] References Cited

U.S. PATENT DOCUMENTS 3,727,442 4/1973 Ridgway et al. ..... 72/446
3,802,013 4/1974 Nebendorf et al. ..... 470/91
4,304,041 12/1981 Kline et al. ..... 29/568
4,898,017 2/1990 Hite et al. ..... 72/405
4,966,028 10/1990 Sakamura et al. ..... 72/405.12
5,005,397 4/1991 Hite et al. ..... 72/405.12
5,263,356 11/1993 Hite et al. ..... 72/456

*Primary Examiner*—David B. Jones
*Attorney, Agent, or Firm*—Pearne, Gordon, McCoy & Granger LLP

[57] ABSTRACT

Tool cassettes in a progressive forging machine are configured to facilitate their machine controlled changeover by the ability to be installed and removed through vertical movement in and out of the machine and by the incorporation of self-alignment features. The die cassettes, which have precision machined cylindrical surfaces, establish the work station centers of the machine on the die breast and receiving zones on the slide for the punch holder cassettes are established with gage blocks that are sized by reference to the respective die work station centers. The cassette system can provide a level of alignment between punch and die elements not previously practical in large machines and a flexibility in tool size that is not subject to the traditional restraint of work station center-to-center distance.

3 Claims, 7 Drawing Sheets

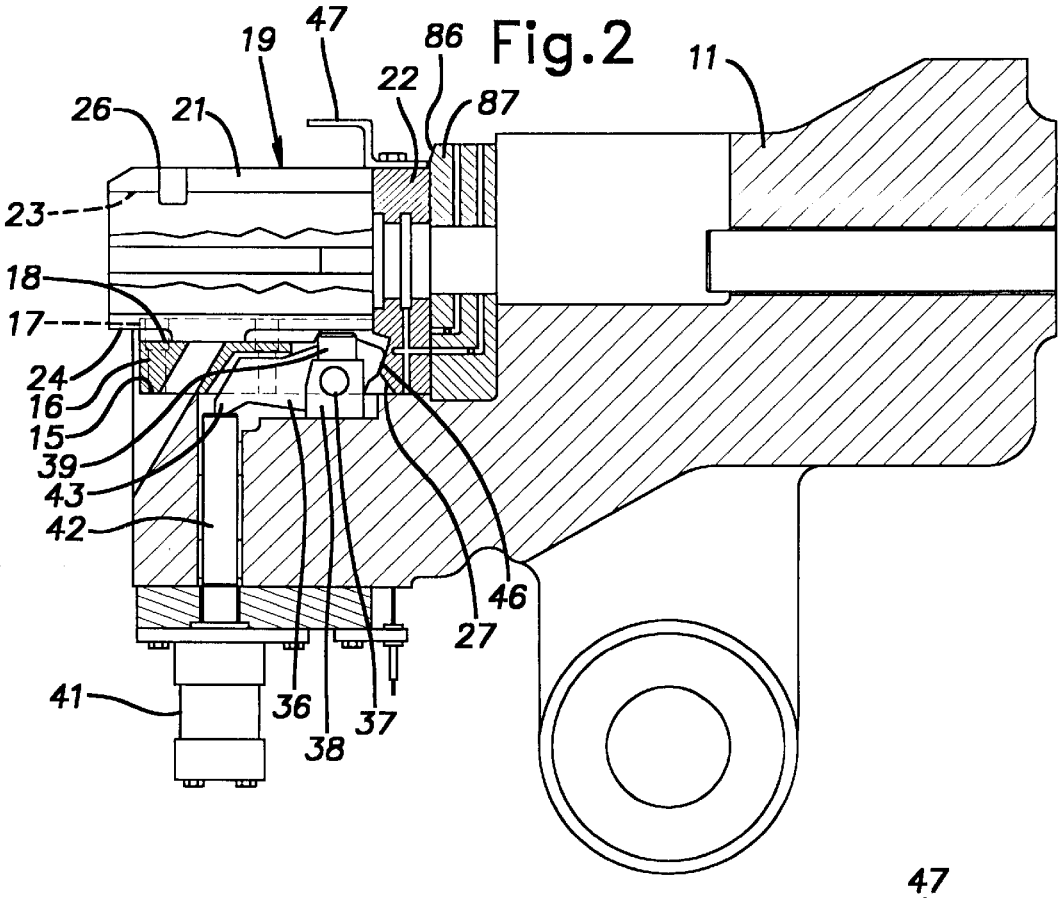
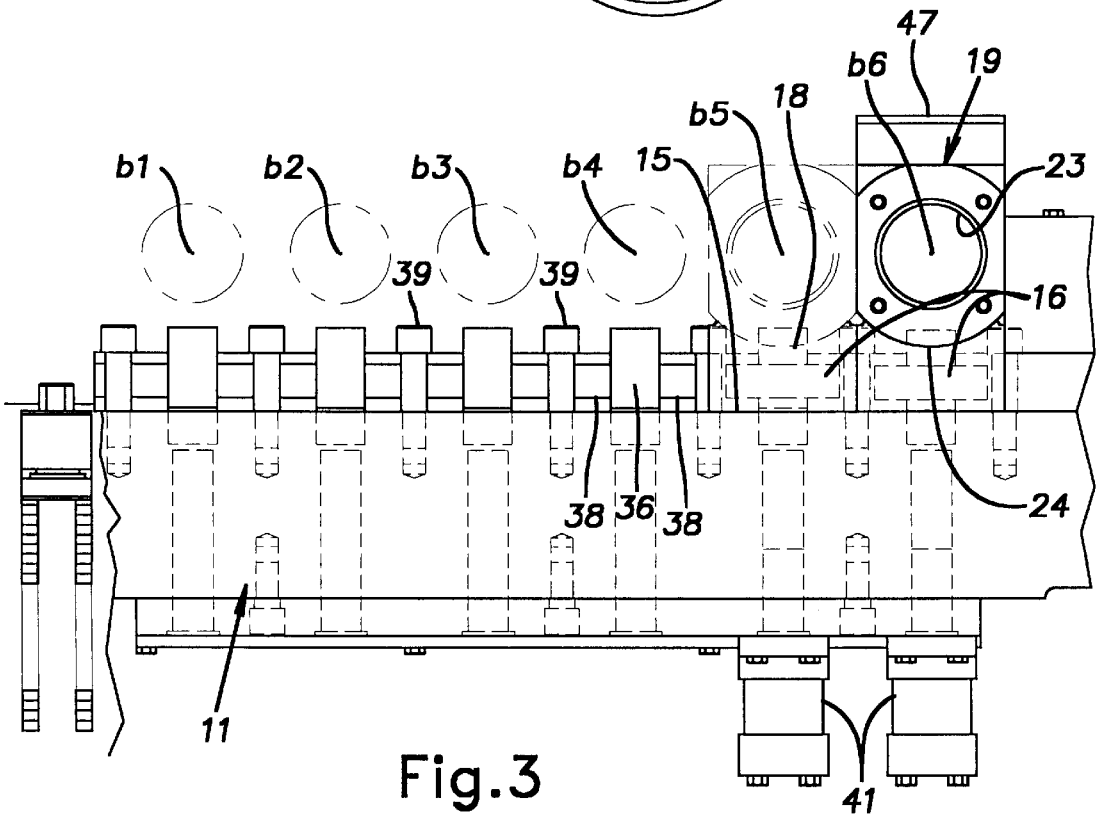
Fig.3

CASSETTE TOOLING

This application is a division of application Ser. No. 08/658,952, filed May 31, 1996.

The invention relates to tool mounting structures for progressive forging machines.

BACKGROUND OF THE INVENTION

Conventional methods of mounting tools in progressive forging machines, particularly in large machines sometimes referred to as formers, during a changeover of tools to make different parts have required certain levels of skill and have often involved many hours of labor. There is, of course, a loss of production when a machine is shut down for a tool changeover. U.S. Pat. No. 4,898,017 assigned to the assignee of the present invention, has advanced the art by facilitating tool changeover procedures. U.S. Pat. No. 4,304,041 also assigned to the assignee of the present invention, illustrates an automatic tool changer for a progressive forging machine.

SUMMARY OF THE INVENTION

The invention provides tool mounting structures in the form of cassettes associated with individual stations of a progressive forging machine. The disclosed cassettes are especially suited for automated tool changeovers. The cassettes have configurations that facilitate their machine controlled manipulation into and out of respective working positions in the forging machine. In particular, the cassettes are configured to be self-aligning to complementarily shaped receiving zones on the forging machine. When a cassette is set into an associated receiving zone, it is automatically locked down by clamping elements integrated in the mechanism of the forging machine.

In the disclosed embodiment, each station of the machine has a pair of associated cassettes. The cassette pair comprises a unit for mounting on the bolster or die breast and a unit for mounting on the slide. In accordance with an important aspect of the invention, the precise position of the receiving area for the slide cassette is permanently established or gaged by measured reference to the actual position of the receiving area on the die breast. This gauging system achieves a level of alignment between die breast and slide work stations in large forging machines that has heretofore not been practical to achieve. As a result of this high degree of alignment at individual stations, longer tool life and higher quality parts can be obtained. The disclosed cassette system has the further advantage of permitting larger parts to be formed in a machine with a fixed center-to-center distance between stations than has been practical before the invention. This potential for making larger parts is achieved by using the cassette itself as a tool holder and in appropriate circumstances, building a particular set of cassettes at one work station larger than normal to accommodate the larger part and, to make room for the oversize set, reducing the size of adjacent cassettes from a normal size.

BRIEF DESCRIPTION OF THE DRAWINGS

FIG. 2 is a fragmentary vertical cross-sectional view through the die breast of the machine at one work station;

FIG. 3 is a fragmentary somewhat schematic elevational view of the die breast as viewed from the slide;

DESCRIPTION OF THE PREFERRED EMBODIMENT

Figure 1:
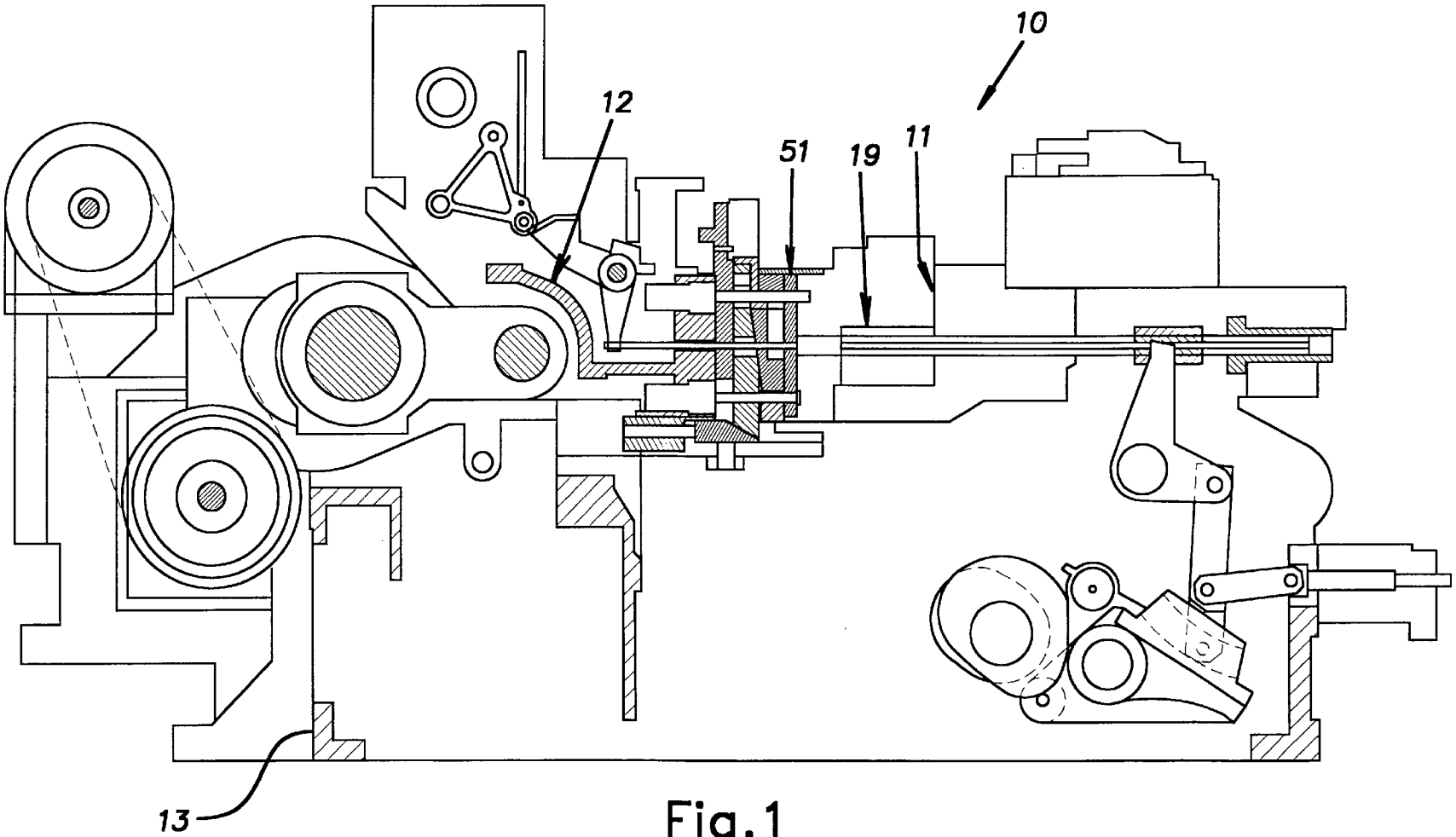
FIG. 1 is a somewhat diagrammatic vertical cross-sectional view taken through a progressive forging machine.

A progressive forging machine 10 diagrammatically illustrated in FIG. 1 includes a die breast 11 on which are mounted dies and a slide or ram 12 on which are mounted tools or punches. The dies and punches are sometimes referred to as tooling. Reference may be made to aforementioned U.S. Pat. No. 4,898,017 for a description of a similar type of forging machine. The die breast 11 and slide 12 each have a plurality of cooperating work stations b1 through b6 and s1 through s6, respectively, indicated at their centers. The die breast 11 is rigid with respect to the machine frame designated 13. The slide 12 riding on liners or bearings reciprocates horizontally towards and away from the die breast to progressively forge workpieces that are transferred to successive work stations b1–b6 on the die breast 11.

FIG. 2 illustrates a typical work station b on the die breast 11 in section. A cradle block 16 is rigidly bolted down on a horizontal surface 15 of the die breast 11 with bolts 17. An upper surface 18 of the cradle block is a concave cylindrical pocket formed by a precision machined area. The imaginary axis of the surface 18 is coincident with the center of the associated work station b and, consequently, is horizontal and is parallel to the direction of slide movement. The cradle block 16 is adapted to support a die cassette 19 which is formed as a bolted assembly of a main body 21 and a plate 22. The main body 21 is precision formed with a cylindrical bore 23 and a cylindrical outer surface 24 concentric with the bore. The radius of the cylindrical cassette body surface 24 is equal to the radius of the cradle surface 18 so that the axis of the bore 23 is situated at and represents the true center of the respective work center b. A tool case or a tool can be locked in the bore 23 by a transverse bar 26 bolted to the body 21. The plate 22 is bolted to a rear face of the body 21. This plate 22 includes a bore aligned with the body bore 23. The plate 22 extends below the body 21 and includes a forward facing side with a chamfer surface 27 at its lower end and an undercut surface 28 adjacent the body 21 inclined forwardly and downwardly. At each station b1–b6 underneath the respective cradle 16, a rocker arm 36 pivots on a shaft 37 carried in blocks 38 retained on the bolster by bolts 39. Each rocker arm 36 is operated by an associated hydraulic actuator 41 having a rod 42 contacting one end 43 of the arm. An opposite end 44 of the arm 36 has a surface 46 engageable with the undercut surface 28 of the plate 22. It will be understood that a separate cradle block 16, rocker arm 36 and actuator 41 is provided for each work station b1–b6. A Z-shaped bracket 47 is bolted to the top of the plate 22 for enabling the die cassette assembly 19 to be manipulated by an automatic handling device.

Figure 4:
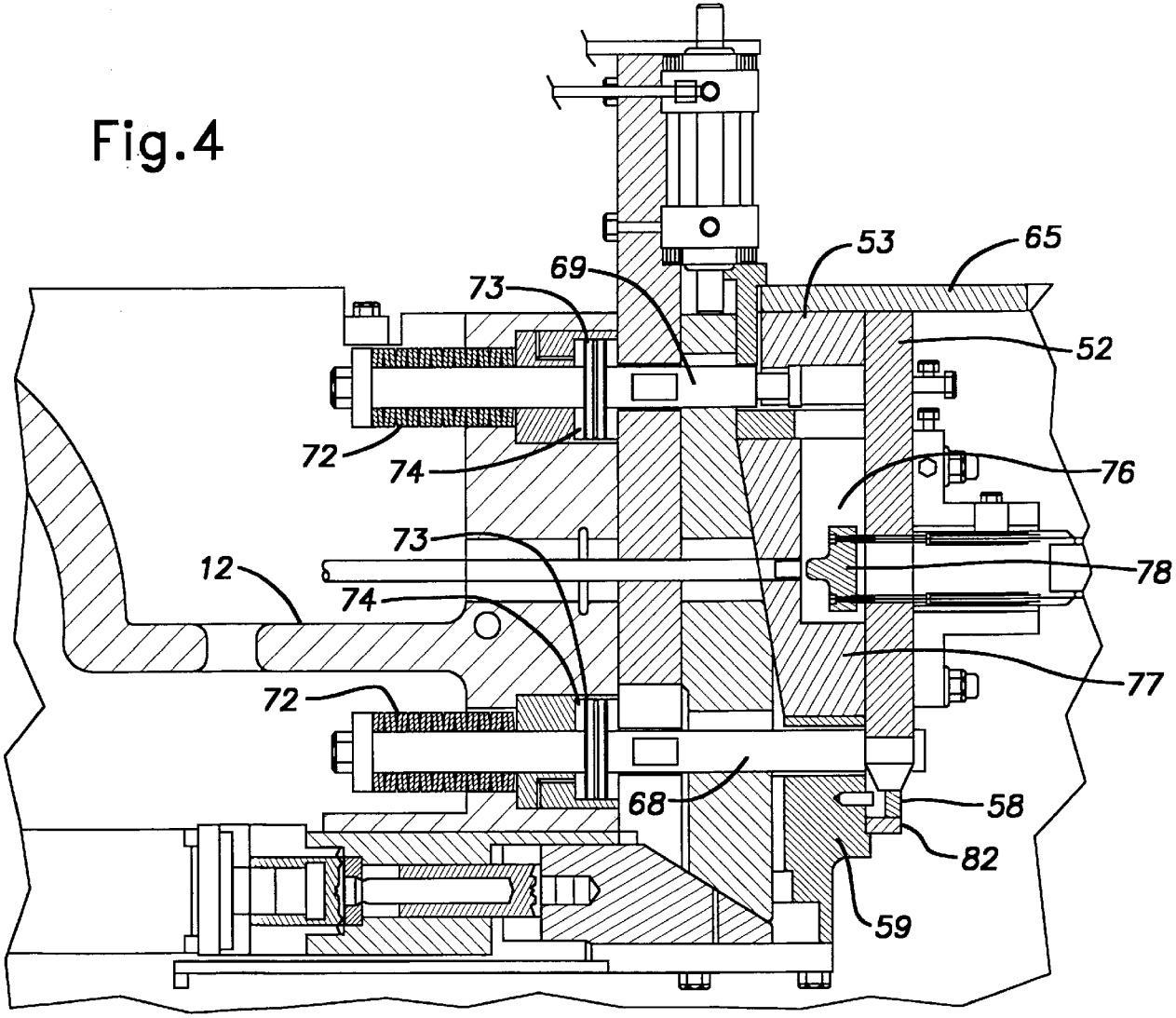
FIG. 4 is a fragmentary somewhat schematic cross-sectional view of the slide at a work station.
Figure 5A:
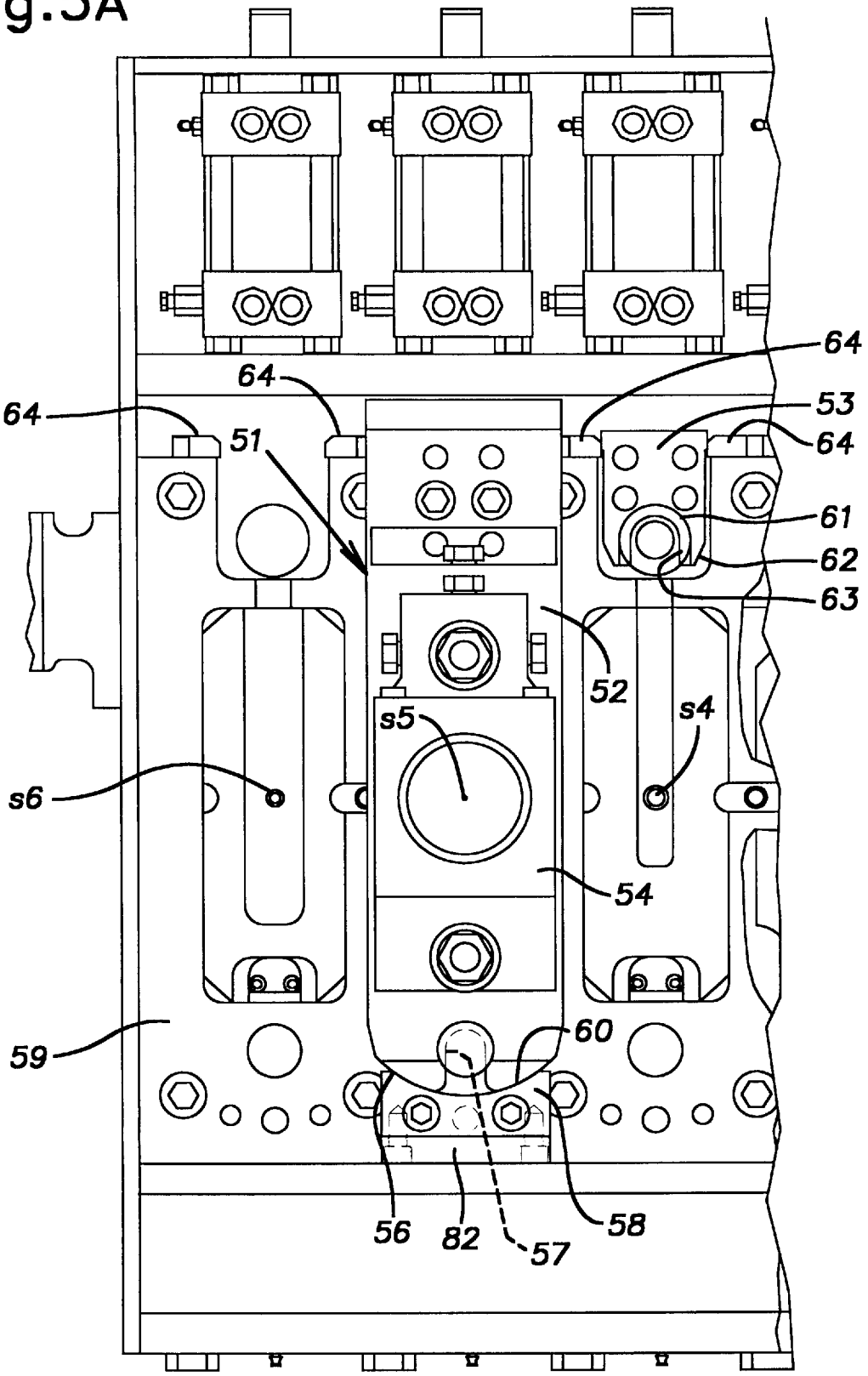
FIGS. 5A and 5B together comprise a somewhat schematic elevational view of the slide with varying degrees of assembly at the several work stations illustrated.
Figure 5B:
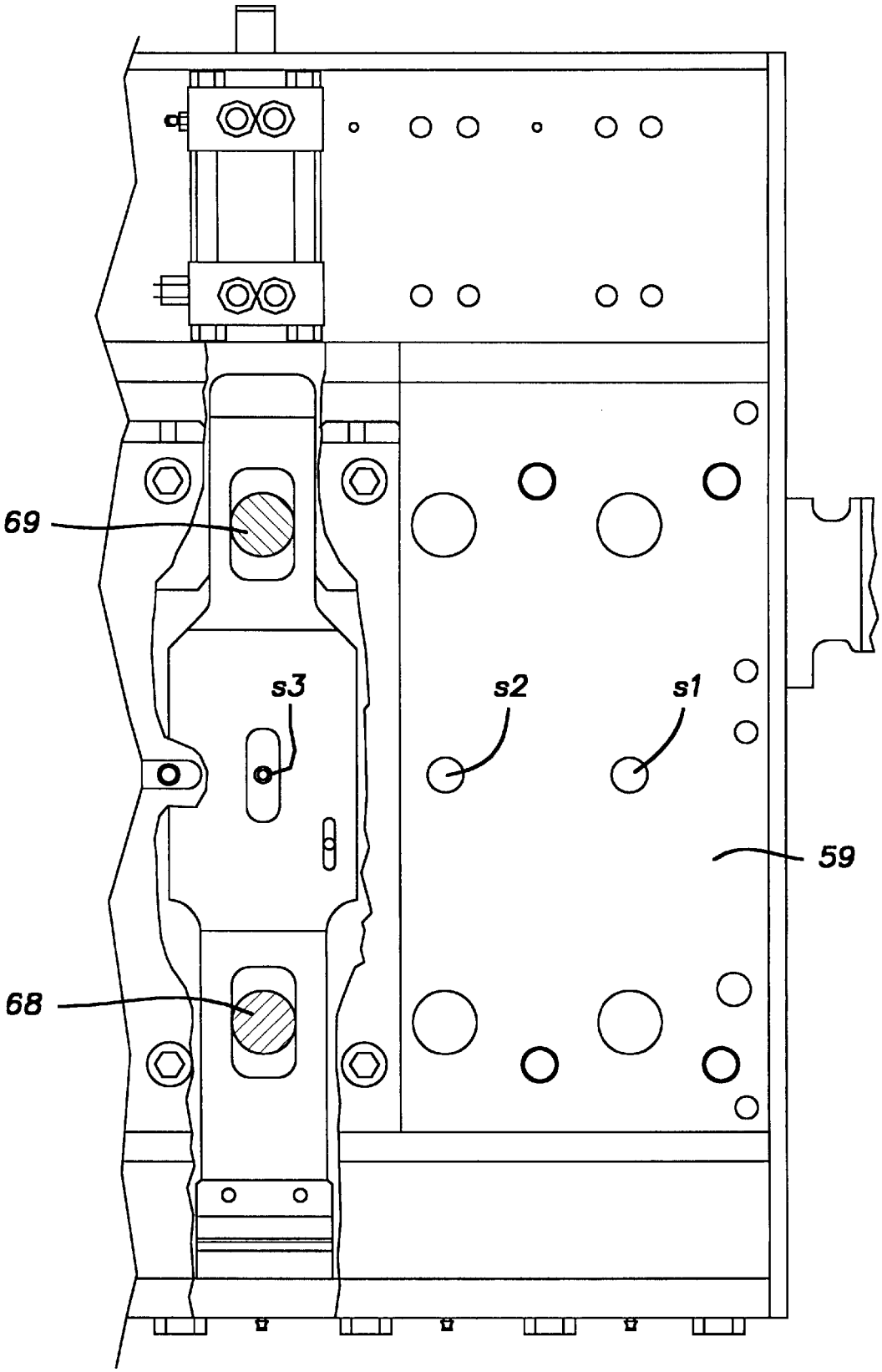
Figure 6B:
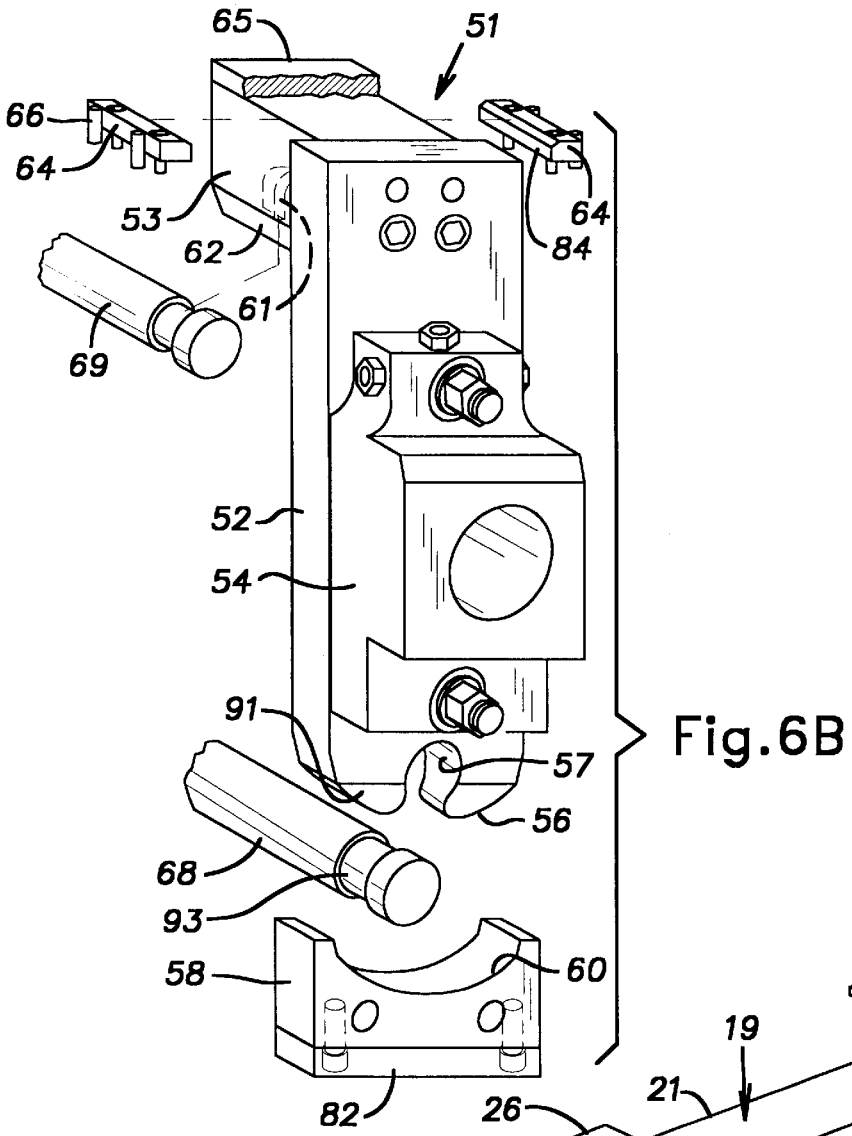
FIG. 6B is a perspective view of a tool cassette for the slide and certain elements for receiving and locating this cassette on the slide.
Figure 6A:
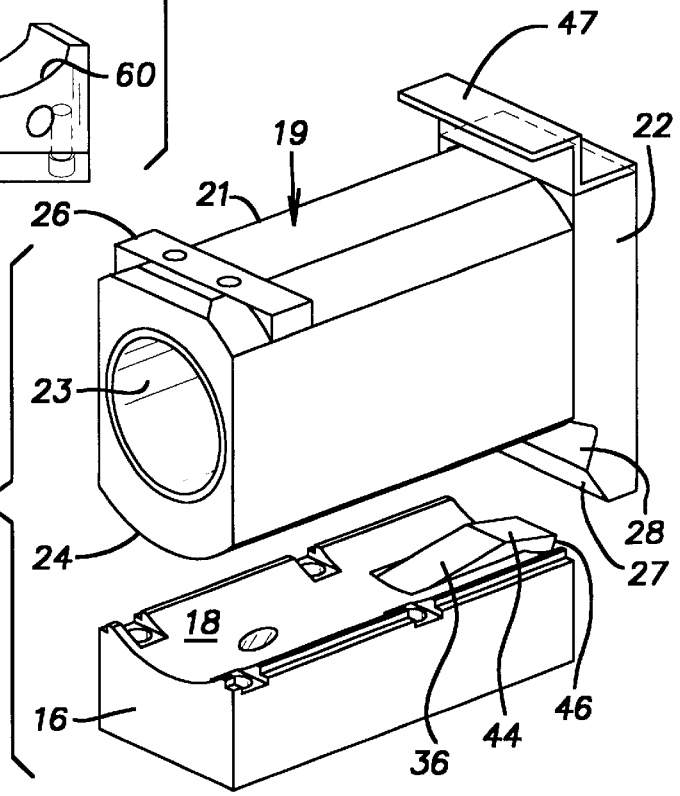
FIG. 6A is a perspective view of a die cassette and a portion of a receiving area carried on the bolster.

Referring now to FIGS. 4, 5*a,b* and 6*b,* a punch holder mounting plate assembly 51 forms a cassette for the tools or punches carried on the slide 12. The mounting plate assembly or cassette 51, as is typical for each of the working stations s1–s6, has the form of an inverted L in side view and is comprised of a vertical plate 52 and a bracket 53 bolted to the vertical plate. A punch holder 54 is typically bolted to the plate 52. The lower end of the plate 52, (FIG. 5A at the station s5) has a profile of a circular arc 56 and a central vertical slot 57. The circular end 56 is received in a cradle block 58 bolted to a machined face block 59 carried on the slide 12. The bracket 53 has a tapered profile at 62 and a central slot 63 on its lower side that includes an internal vertical clamping shoulder 61 revealed at the station s4 in FIG. 5A where the bracket is shown with the plate 52 removed. The bracket 53 is received between a respective pair of gage blocks 64 mounted by bolts on the top of the face block 59 against dowel pins 66 pressed into the slide mounted block 59. The mounting plate assembly or cassette 51 is retained on the slide 12 by a pair of clamp bars 68, 69 disposed in the respective slots 57 and 63. Spring packs 72 bias the bars 68, 69 to a clamping position, in a direction away from the die breast 11, and hydraulic pistons 73 in chambers 74 are actuated to override the clamping force of the springs 72 and release the assembly 51. The L-shaped configuration of the assembly 51 and a recess 76 in an associated component 77 affords a space for a knockout 78 or other instrumentality associated with a tool. A plate 65 suitably attached to the top of the cassette assembly 51 enables the assembly to be handled conveniently for example, by an overhead robotic arm.

Figure 7A:
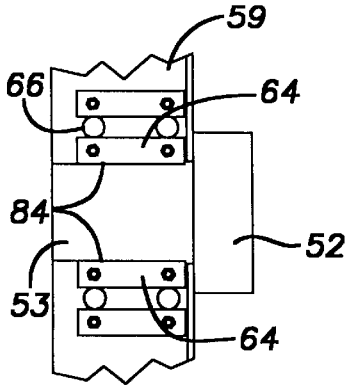
FIG. 7A is a fragmentary plan view of a portion of the slide that receives an associated part of a tool cassette.
Figure 7:
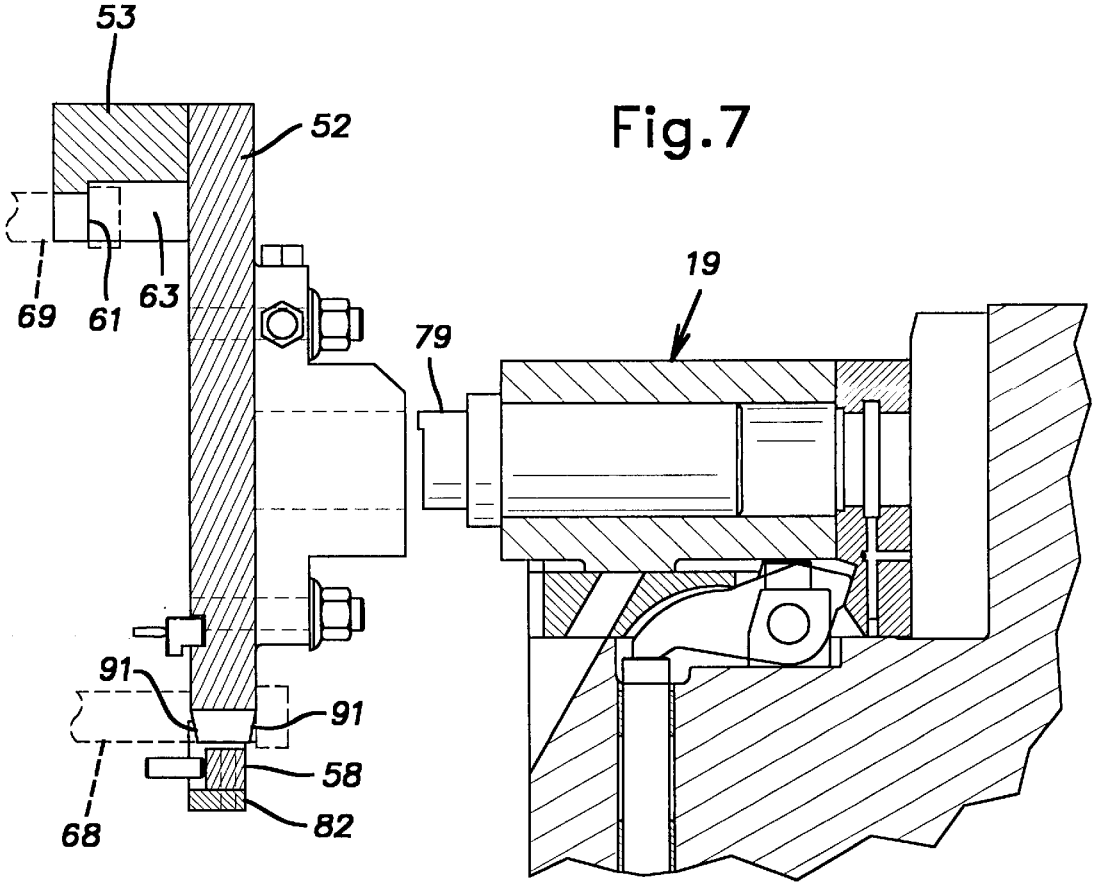
FIG. 7 is a schematic cross-sectional elevational view of a fixturing system for aligning the bolster and slide cassettes.

With reference to FIG. 7, in accordance with the invention, the tool supporting structures on the bolster or die breast 11 and slide 12 in the form of the cassettes 19, 51 in the disclosed embodiment, at each work station, are mutually precisely located relative to one another so that the axes of their centers are coincident to the extent that measurement and precision adjustment permit. The alignment can be accomplished by positioning a fixture 79 in a die cassette 19 mounted and clamped on the cradle 16 of a particular work station. With the slide 12 in an advanced position and a punch cassette 51 coarsely located on its cradle 58, measurements can be made between the fixture 79 and a punch holder 54 on the punch cassette to determine any eccentricity existing between the axis of the fixture 79, and therefore the die cassette bore 23, and the center on the punch cassette represented by the bore in the punch or tool holder 54. A gage block 82 is precision ground in its vertical dimension and located under the cradle block 58 to vertically adjust the cradle block so that the axis of its tool holder 54 is at the same vertical location as is the bore 23 of the die cassette. The gage block 82 is bolted to the cradle block 58 and those elements are bolted to the slide mounted face block 59.

The pair of gage blocks 64 that straddle the bracket 53 at the upper end of the tool cassette 51 are precision ground in their horizontal width to adjust and thereby locate the cassette so that the center of its tool holder 54 is horizontally precisely aligned with the center of the die cassette bore 23. Each gage block 64 rests horizontally against dowel pins 66 press fitted into the top of the face plate 59 and are bolted to this top surface. The surfaces 84 of the gage blocks 64 in contact with the cassettes are in vertical planes parallel to the slide motion and opposite surfaces rest against the dowel pins 66 pressed into the block 59. The actual work station center on the punch holder 51 is roughly midway between the cradle block 58 and the gage blocks 64. The arcuate shape of the cradle surface, designated 60, which is cylindrical and has an axis parallel to slide movement allows the cassette to pivot about this surface for horizontal adjustment of the center without significantly affecting the vertical position of the center. To make initial measurements, slightly undersize gage blocks can be used at the top face plate block 59. The measurement and alignment technique is done manually at each work station s1–s6 when the machine is originally manufactured. Particularly on large machines, this technique produces a degree of alignment between the die and punch work stations b1–b6 and s1–s6 that has not been practically achieved in earlier constructions.

The cassettes 19 and 51 are adapted to be manipulated automatically with a robotic tool changer similar to that shown in aforementioned U.S. Pat. No. 4,304,041. An overhead arm of the automatic tool changer can be arranged to grip one or simultaneously both cassettes 19, 51 at any particular work station. The die cassette 19 is gripped at the Z-shaped plate 47 and the punch cassette is gripped at the plate 65. The automatic tool changer is positioned over such work station and the cassettes 19, 51 are lowered towards their respective positions on the bolster 11 and slide 12. At this time, the surface 46 of the rocker arm 36 is retracted by lowering the rod 42 and adjacent end 43 of the arm through control of the actuator 41 by signals from the machine controller. In this position, the gripping surface 46 is nearly vertical and there is sufficient clearance between it and the bolster to allow passage therebetween of the lower end of the plate 22. The chamfer surface 27 on the lower end of the plate 22 and a chamfer 86 on a bolster plate 87 facilitate registration of the die cassette into the receiving zone formed by the cradle surface 18 in the lateral direction and by the bolster plate 87 and the clamp arm end 43 in the axial or slide direction. The concave surface 18 of the cradle block 16 mating with the convex surface of the main body 21 guides the die cassette 19 as needed in directions lateral of the direction of slide movement. Thus, the die cassette 19 and its receiving zone are mutually self-aligning.

With the cassette 19 resting on the cradle block 16, the master controller for the machine causes the actuator 41 to extend the rod 42 upwardly to rock the arm 36. The arm surface 46, because it reacts against the inclined or undercut surface 28 which extends in both horizontal and vertical directions, causes the cassette 19 to be tightly drawn against the breast plate 87 and onto the cradle 16. The cassette 19 is, consequently, accurately located in the same position on the cradle 16 each time it is installed.

At the same time as the automatically controlled tool changer is lowering the die cassette 19 into place, it can lower the punch cassette 51 into position on the slide. The lower end of the plate 52 is tapered at 91, as viewed from the side in FIG. 4 allow self-alignment to the annular grooves 93, in the respective clamp bar 68, in both axial directions parallel to the slide motion. At the lower end of the plate 52, the cassette 51 is self-aligning to the clamp bar 68 by virtue of a rounded throat opening of the slot 57 and the round cross-section of the bar. When fully lowered, the convex surface 56 on the lower end of the plate 52 is self-aligning with the concave surface 60 of the cradle 58. At the upper end of the punch cassette 51, the bracket leg 61 is self-aligning to the gage blocks 64 by virtue of its tapered profile 62 enabling this part of the cassette to align itself laterally between the opposed set of gage blocks as it is lowered into position. It will be understood that surfaces 84 of the gage blocks 64 which laterally confine the cassette 51 lie in vertical planes parallel to the axis of slide motion. As previously described, the gage blocks 64, cooperating with the cradle block 58, which is vertically gaged by the block 82, constrain the cassette into a position that is precision aligned with the die cassette 19.

It will be understood by those skilled in the art that ordinarily a die cassette will have its bore 23 supporting a tool holder which in turn will support an actual die. However, there may be occasion in the making of specific parts that it is desirable to make a die larger than would ordinarily be used with a machine of a given center-to-center distance between stations. In such a case, the main body 21 of the die cassette can be used as a tool holder itself. Still further, where a part being made is relatively oversize, it is possible to make a special die cassette at a particular station with oversize dimensions in a lateral direction, but keeping the geometry of the cylindrical surface 24. In such a case, adjacent die cassettes would be correspondingly reduced in size. If necessary, similar techniques can be used on the tool cassettes on the slide.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

I claim:

1. A punch holder cassette having a front face with an elongated profile and a side with an inverted L-shaped profile, a lower end of the front face having an arcuate profile and having a central vertically extending slot adapted to straddle an annular groove in a round clamp bar, the rear of the cassette being formed by the hook of the L-shape, the hook having a taper at its lower end in a plane parallel to the front face so that it is adapted to align itself between a pair of spaced gage blocks and having a central vertical slot adapted to straddle an annular groove in a round clamp bar.

2. A die cassette comprising a main body and a clamping extension fixed to the body, the body having a through bore adapted to receive a tool holder, a lower face of the body having a cylindrical surface concentric with the bore, the clamping extension including an undercut inclined surface that extends downwardly away from the body and forwardly towards the body, the undercut surface being adapted to be engaged by a clamping bar to draw the lower face of the body against a cylindrical cradle and a rear face of the cassette against a bolster plate surface.

3. A die cassette as set forth in claim 2, wherein the body has generally flat side surfaces parallel to one another and the axis of the bore.

* * * * *